United States Patent [19]

Fischer et al.

[11] 4,085,599

[45] Apr. 25, 1978

[54] PADLOCK ADAPTER ASSEMBLY

[75] Inventors: Don G. Fischer, Peru; Harold Holland, Wabash, both of Ind.

[73] Assignee: Square D Company, Park Ridge, Ill.

[21] Appl. No.: 799,630

[22] Filed: May 23, 1977

[51] Int. Cl.[2] ..... E05B 73/00

[52] U.S. Cl. ..... 70/14; 70/19; 70/DIG. 63

[58] Field of Search ..... 70/14, 19, 58, 57, 61, 70/200, 203, DIG. 63

[56] References Cited

U.S. PATENT DOCUMENTS

| | | | |
|---|---|---|---|
| 2,560,624 | 7/1951 | Bartlett | 70/14 |
| 2,707,125 | 4/1955 | Ritter | 292/341.15 |
| 2,963,895 | 12/1960 | Thomas | 70/14 |
| 3,667,259 | 6/1972 | Reque | 70/14 |
| 3,889,497 | 6/1975 | Tuttle | 70/14 |
| 3,926,018 | 12/1975 | Joersz | 70/19 |
| 3,988,031 | 10/1976 | Meyer | 292/153 |

*Primary Examiner*—Robert L. Wolfe

*Attorney, Agent, or Firm*—Richard T. Guttman; Norton Lesser

[57] ABSTRACT

The following specification describes a padlock adapter assembly comprising a pair of identical stamped plates each having a pair of spaced passages aligned with a respective passage in the other plate to form a pair of aligned passages for receiving a respective padlock shackle. A hook on one end of each plate is pivoted toward or away from the other hook about an axis through either pair of aligned passages when the respective one of two padlock shackles is removed to permit access to an enclosure.

8 Claims, 6 Drawing Figures

PADLOCK ADAPTER ASSEMBLY

BACKGROUND OF THE INVENTION

1. Field of the Invention

This invention relates in general to padlock adapters and more specifically and an improved or more economical padlock adapter permitting alternative access to enclosure.

2. Summary of the Prior Art

Padlock adapters providing for alternative access to a restricted or padlocked enclosure are often used for enabling either the owner of the premises on which the enclosure is maintained or a utility representative, for example, to enter the enclosure without requiring the presence of the other. For this purpose a padlock adapter is employed, which may have a separable locking member secured to a body member at either of two positions for enabling either party on removal of his lock to gain access to the enclosure. Such an arrangement is typically shown in U.S. Pat. No. 3,889,497 or U.S. Pat. No. 2,963,895.

U.S. Pat. No. 3,889,497 discloses a lock adapter assembly in which a separable plate is removably held between the legs of a relatively expensive U shaped locking plate and U.S. Pat. No. 2,963,895 shows a common member movably secured to a pair of pivotable arms either of which can be released to permit access to a restricted area. Both types of adapters are accordingly relatively expensive.

SUMMARY OF THE INVENTION

In the present invention a padlock adapter assembly is provided by two identically formed plate members pivotable relative each other about either of two axes to separate hook ends on each plate member from the latch elements of an enclosure.

Thus one plate member has spaced passages aligned with respective spaced passages in the other plate with each pair of aligned passages receiving a shackle of a respective padlock. If either shackle is removed, the plate members pivot about the axis of the other passages or shackle to enable the hook members to move toward or from each other for unlocking the enclosure and toward each other to enable the enclosure to be again double padlocked.

A rivet passing through an elongate slot in each member secures the plate members together while enabling their relative pivotable movement.

It is therefore a primary object of the present invention to provide an economical or improved lock adapter assembly for enabling either of two parties to secure access to a restricted enclosure.

Other objects and features of the present invention will become apparent on examination of the following specification and claims together with the accompanying drawings.

DESCRIPTION OF THE PREFERRED EMBODIMENT

Figure 1:
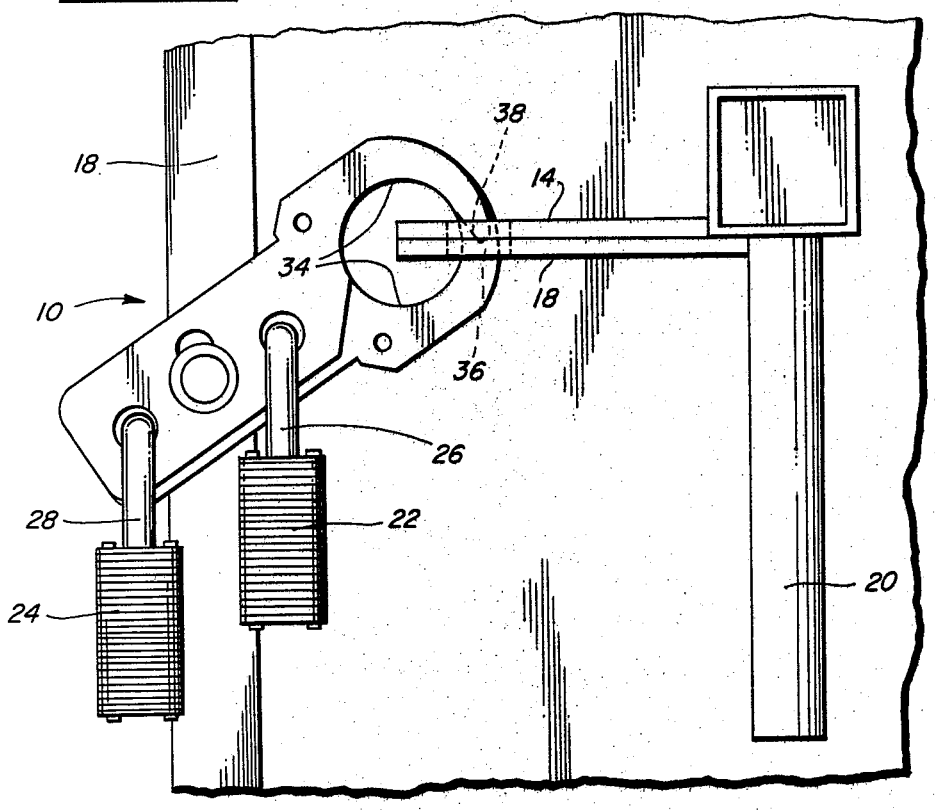
FIG. 1 illustrates the assembly incorporating the principles of the present invention arranged on the latch elements of an enclosure.

In FIG. 1 a padlock adapter assembly is indicated generally by the reference number 10. The assembly 10 is shown mounted on a pair of latch elements or members 12 and 14 to prevent relative movement between a door 18 fixed, for example, to one of the latch elements 12 and a frame member 18. The other latch member 14 is ordinarily connected to a bolt adapted to release the door 16 from the frame member in response the operation of a handle 20 in any conventional manner or may be connected to the frame member in any conventional manner. As seen in FIG. 1 the assembly 10 is locked by two spaced padlocks 22 and 24 each having an arcuate or U shaped shackle 26 and 28 respectively.

The assembly 10 comprises a pair of substantially identical generally planar plate members 30 and 32 with each member 30 and 32 having an arcuate semi annularly shaped hook or jaw portion 34 for movement toward each other and through aligned passages 36 and 38 in latch elements 12 and 14 respectively for latching the door 16. Each plate member 30 and 32 includes an elongate flat leg 40 extending radially from the respective hook at a position spaced from the free end of the hook.

Each leg 40 has first and second spaced passages of apertures 42 and 44. The apertures 42 and 44 lie on a common axis and have a diameter of substantially 0.4 inch with one aperture 42 located adjacent the jaw 34 and the other aperture 44 located substantially 1.5 inch from aperture 42.

A slot 46 is located substantially midway or intermediate the passages 42 and 44. The slot 48 is approximately 0.31 inch wide and has an elongate axis substantially $\frac{3}{4}$ inch arranged at an angle of 15 ° to the axis joining passages 42 and 44 but offset from the axis joining apertures 42 and 44 by about 0.05 inch in the direction of the closed back of the hook. The apertures or passages 42 and 44 of each plate member are adapted to be aligned with a respective passage 42 and 44 of the other plate to receive a shackle 26 and 28 of a respective padlock 22 and 24.

The plates 30 and 32 are easily and economically formed by simple stampings and assembled by rotating one plate 180° with respect to the other so that the jaws 34 extend toward each other to define an encircled area and the slots 46 extend in opposite or transverse directions at substantially 150° to each other.

The plates 30 and 32 are then secured together by a rivet 48 passing through the intermediate slot 46 with bearing washers 50 underlying the rivet heads. The rivet has a somewhat smaller diameter than the slot width so as not to hinder relative pivotable movement between the plates 30 and 32 about the axis of either passage 40 or 42.

Figure 2:
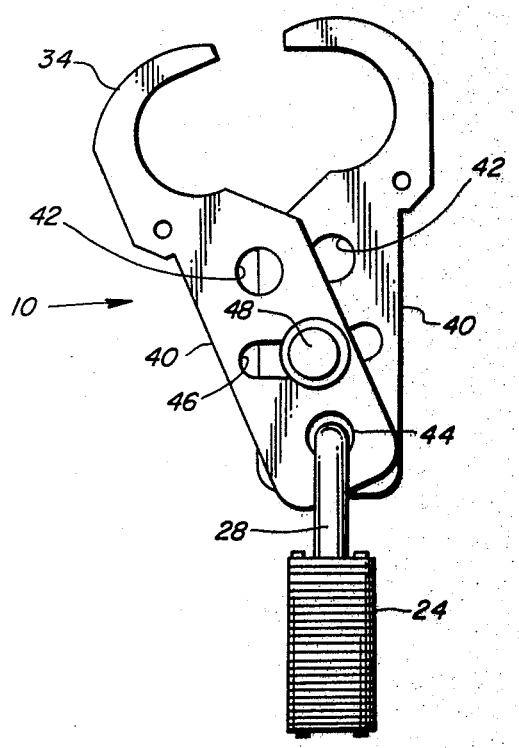
FIG. 2 illustrates the assembly in an open condition with one padlock removed.

With the adapter assembly 10 in the position shown in FIG. 1 and the shackle 26 of padlock 22 belonging to one of the parties entitled to access and extending through passages 42 removed from the apertures 42, the assembly 10 may be disengaged from the latch elements 12 and 14 by simply pivoting the members about the axis of apertures 44 as seen in FIG. 2 to separate the hooks 34. This movement is permitted by the slots 46, whose elongate axis enables substantial separation of the hooks. Thereafter the hooks are passed through aligned apertures 36 and 38 in the latch elements 12 and 14 and when apertures 42 are aligned the shackle 26 is passed therethrough and the padlock operated to relock the premises.

Figure 3:
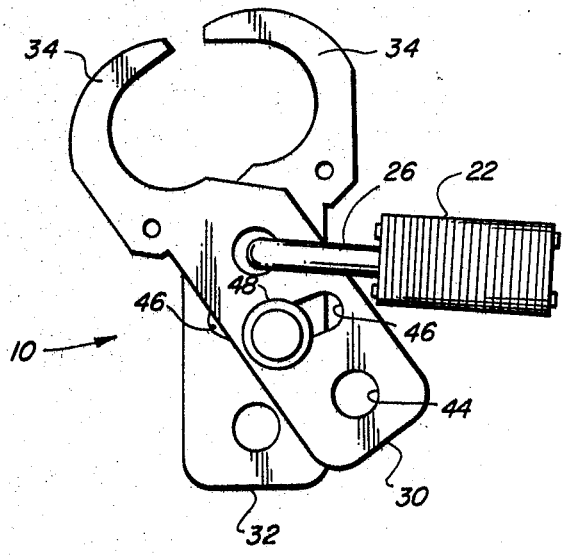
FIG. 3 illustrates the assembly in open condition with the other padlock removed.
Figure 4:
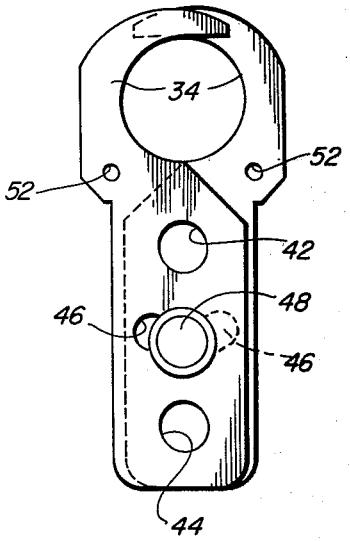
FIG. 4 is a front elevational view of the members in closed condition.
Figure 5:
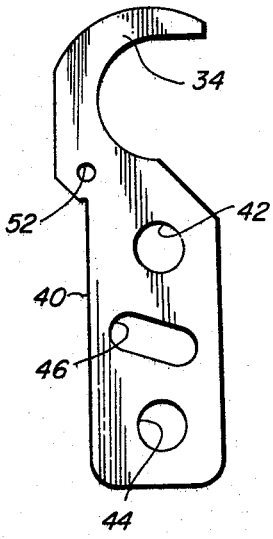
FIG. 5 is a front elevational view of one of the members.
Figure 6:
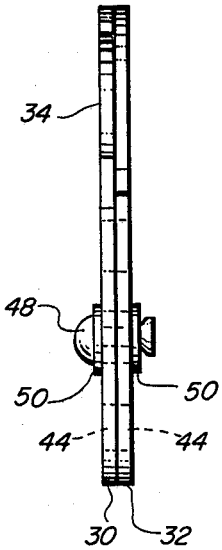
FIG. 6 is a side elevational view of the assembly.

The lock 24 is disengaged from assembly 10 by the other party having access to the enclosure, removing shackle 28 from passages 44. Jaws or hooks 34 are disengaged from the latch elements 12 and 14 by pivoting members 30 and 32 about the axis of passages 42. This pivots hooks 34 in one direction and the passages 44 in the other direction, as seen in FIG. 3, while the slots 46 move in the same direction as respective passages 44. The hooks 34 of course do not move as far apart as shown in FIG. 1 since the outer periphery of the hooks are substantially only 2 inches from apertures 42 and approximately 3½ inches from apertures 44. Relocking is provided by simply pivoting the hooks 34 toward each other through passages 12 and 14 and when apertures 44 are aligned, shackle 28 is passed therethrough and the enclosure padlocked.

A small aperture 52 is additionally provided in the corner of each plate 30 and 32 adjacent the junction of jaw 34 and leg 40 for use in providing a seal or for other purposes. A seal wire extending between each opening 52 being broken in response to the unauthorized pivoting movement of the members 30 and 32 indicates prior entrance.

The foregoing constitutes a description of an improved padlock adapter assembly, whose inventive concepts are believed set forth in the accompanying claims.

What we claim is:

1. A padlock adapter assembly for use with a plurality of padlocks each having a shackle to enable any one said padlocks to be retained on said assembly while enabling said assembly to be detached from a latch element, the improvement comprising:

a pair of plates each having a pair of spaced passages with each passage adapted to be aligned with a respective spaced passage in the other plate for receiving a shackle of a respective padlock through the aligned pair of passages, and means formed adjacent one end of each plate for engagement with said latch element to prevent entrance into a closure and pivotable about an axis passing through either passage of said pair of spaced passages for releasing said means from said latch element in response to the removal of the respective shackle.

2. In the adapter assembly claimed in claim 1, means securing said plates together at a position spaced intermediate each pair of spaced passages and enabling said plates to pivot relative each other about a shackle in the aligned pair of passages.

3. In the adapter assembly claimed in claim 2 in which said means securing said plates comprises a rivet extending through a slot in each plate.

4. In the adapter assembly claimed in claim 3 in which each slot has an elongate axis extending at an angle to a line joining the axis of each pair of spaced passages.

5. The adapter assembly claimed in claim 4 in which the elongate axis of one slot extends transversely at substantially 150° to the elongate axis of the other slot in response to the engagement of said means with said latch element.

6. In the assembly claimed in claim 5 in which said plates are substantially identical and said means formed adjacent one end of each plate comprises an arcuate hook extending in opposite directions for passage through aligned apertures in said latch elements.

7. A padlock adapter assembly for use with a plurality of padlocks each having a shackle to enable any one said padlocks to be retained on said assembly while enabling said assembly to be detached from a pair of latch elements having aligned apertures, the improvement comprising:

a pair of plates each having a pair of spaced passages with each passage aligned with a respective spaced passage in the other plate for receiving a shackle of a respective padlock through the aligned pair of passages each plate having an elongate slot located intermediate the pair of spaced passages, means passing through each slot for securing said plates together at a position spaced intermediate said passages and enabling said members to pivot relative each other about a shackle in either pair of aligned passages in response to the removal of a shackle in the other pair of aligned passages, and a hook formed adjacent one end of each plate for passage in one direction through said aligned latch member apertures for preventing entrance into a closure in response to the receipt of a shackle in each pair of aligned passages for passage in the opposite direction from said aligned apertures in response to the removal of one of said shackles from one pair of aligned passages and relative pivotable movement between said plates about an axis passing through the other pair of aligned passages.

8. The assembly claimed in claim 7 in which each plate includes a passage for receiving a seal wire adapted to be broken in response to pivoting movement of said plates about a selected axis.

* * * * *

UNITED STATES PATENT AND TRADEMARK OFFICE

CERTIFICATE OF CORRECTION

PATENT NO. : 4,085,599

DATED : April 25, 1978

INVENTOR(S) : Don G. Fischer and Harold Holland

It is certified that error appears in the above-identified patent and that said Letters Patent are hereby corrected as shown below:

Col. 2, line 30, change "of" to --or--.

Signed and Sealed this

*Third* Day of *July 1979*

[SEAL]

*Attest:*

*Attesting Officer*

LUTRELLE F. PARKER

*Acting Commissioner of Patents and Trademarks*